US009871332B2

(12) United States Patent
Liao

(10) Patent No.: US 9,871,332 B2
(45) Date of Patent: Jan. 16, 2018

(54) ELECTRICAL CONNECTOR

(71) Applicant: FOXCONN INTERCONNECT TECHNOLOGY LIMITED, Grand Cayman (KY)

(72) Inventor: Fang-Jwu Liao, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/588,701

(22) Filed: May 8, 2017

(65) Prior Publication Data

US 2017/0324203 A1 Nov. 9, 2017

(30) Foreign Application Priority Data

May 6, 2016 (CN) ..... 2016 2 0402889 U
Dec. 21, 2016 (CN) ..... 2016 2 1412104 U

(51) Int. Cl.

*H01R 13/62* (2006.01)
*H01R 33/74* (2006.01)
*H01R 12/70* (2011.01)
*H01R 12/88* (2011.01)

(52) U.S. Cl.

CPC ..... *H01R 33/74* (2013.01); *H01R 12/7076* (2013.01); *H01R 12/7082* (2013.01); *H01R 12/88* (2013.01)

(58) Field of Classification Search

CPC .. H05K 7/1023; H05K 7/1061; H05K 7/1007; H05K 7/1053; H05K 3/325; H01R 23/684
USPC ..... 439/73, 331
See application file for complete search history.

(56) References Cited

U.S. PATENT DOCUMENTS 7,101,210 B2 * 9/2006 Lin ..... H05K 7/1061 439/331
7,497,717 B2 * 3/2009 Zhang ..... H05K 7/1053 439/331
7,666,022 B2 * 2/2010 Yeh ..... H05K 7/1007 439/331
7,699,637 B2 * 4/2010 Yeh ..... H01R 13/64 439/135
7,726,978 B2 * 6/2010 Liao ..... H05K 7/1053 439/331
8,647,138 B1 2/2014 Chen

* cited by examiner

*Primary Examiner* — Hien Vu
(74) *Attorney, Agent, or Firm* — Wei Te Chung; Ming Chieh Chang

(57) ABSTRACT

An electrical connector connecting with a chip module includes a base with a receiving space and a cover covering on the base. The cover includes a first edge, a second edge, a third edge and a fourth edge. The four edges connect with each other to form four engaging portions, and a rectangular opening surrounded therein. The first edge is pivotally connected to the base. The cover includes an extending portion extending from the second edge. The cover includes four pressing portions located at four inner corners of the cover.

10 Claims, 8 Drawing Sheets

ELECTRICAL CONNECTOR

BACKGROUND OF THE INVENTION

1. Field of the Invention

The present invention relates to an electrical connector, and particularly to an electrical connector with a chip module mounted thereon.

2. Description of Related Art

U.S. Pat. No. 8,647,138 discloses an electrical connector. The electrical connector includes an electrical connecting base for bearing a chip module, a pressing cover and an operating member. The pressing cover covers on the electrical connecting base, and has a first pressing portion and a second pressing portion for pressing the chip module. The first pressing portion and the second pressing portion are respectively located on two sides of the pressing cover. When the first pressing portion and the second pressing portion are pressed down to the chip module, the chip module may tend to be damaged easily because of the force may be concentrated around one position on each side.

Therefore, an improved electrical connector which can avoid damaging the chip module is desired.

SUMMARY OF THE INVENTION

Accordingly, an object of the present invention is to provide an electrical connector connecting with a chip module, and including a base with a receiving space and a cover covering on the base. The cover includes a first edge, a second edge, a third edge and a fourth edge. The four edges connect with each other to form four engaging portions, and a rectangular opening surrounded therein. The first edge is pivotally connected to the base. The cover includes an extending portion extending from the second edge. The cover includes four pressing portions located at four engaging portions of the four edges for achieving a force balance when the chip module is pressed by the pressing portions.

These and other aspects of the present invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
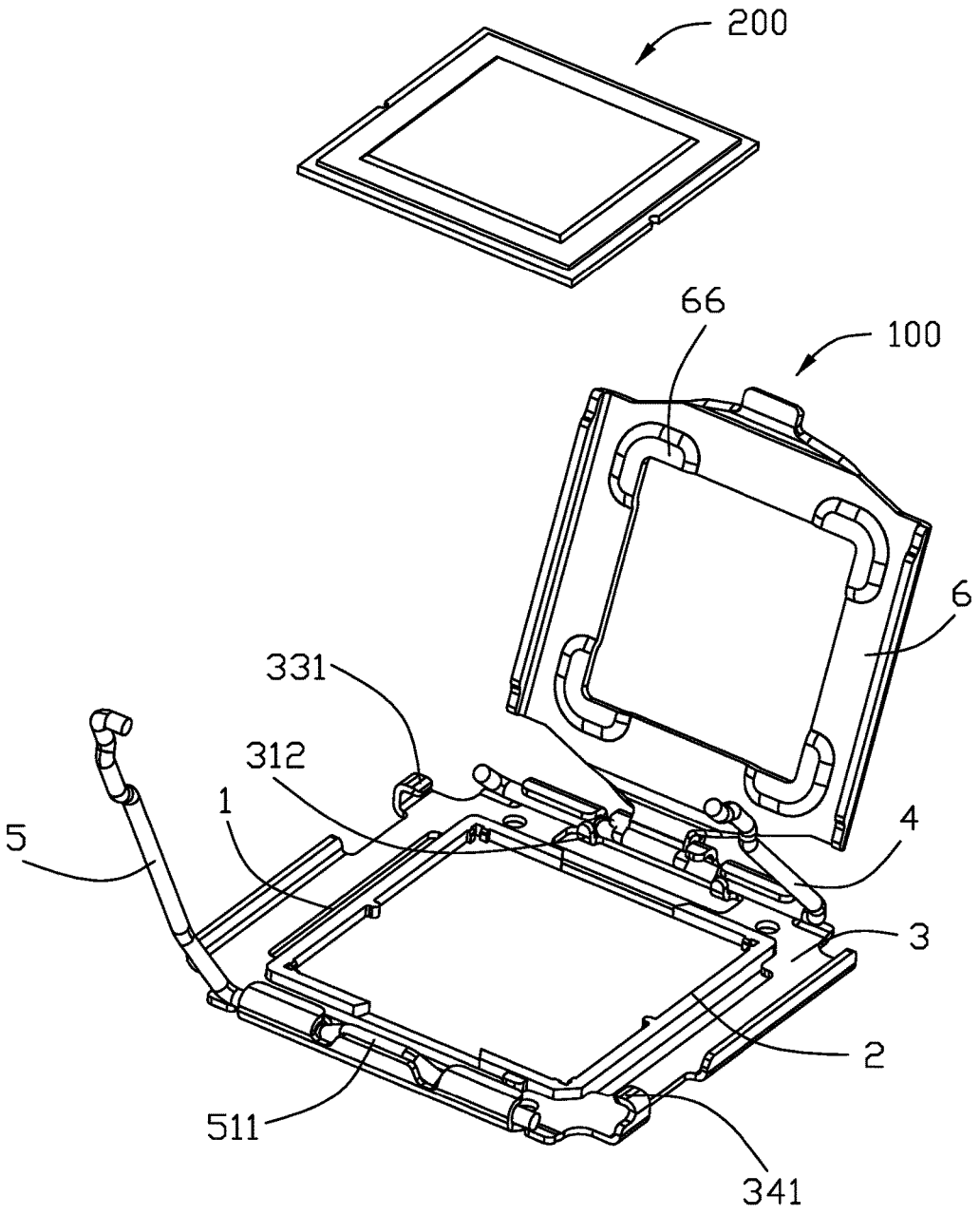
FIG. 1 is a perspective view of an electrical connector and a chip module of the invention.
Figure 2:
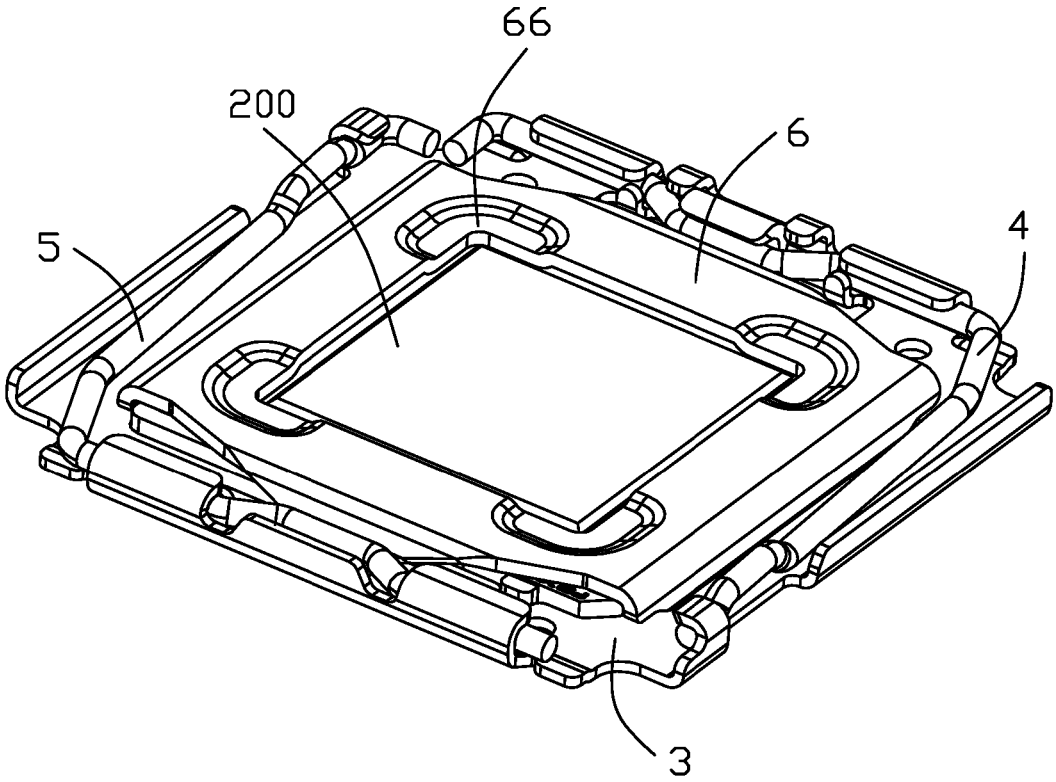
FIG. 2 is a perspective view of the electrical connector with the chip module mounted thereon of FIG. 1.

Referring to FIGS. 1 and 2, an electrical connector 100 of the present invention is used for connecting a chip module

200 to a circuit board (not shown). The electrical connector 100 includes a base 1 and a cover 6 covering on the base 1.

Figure 3:
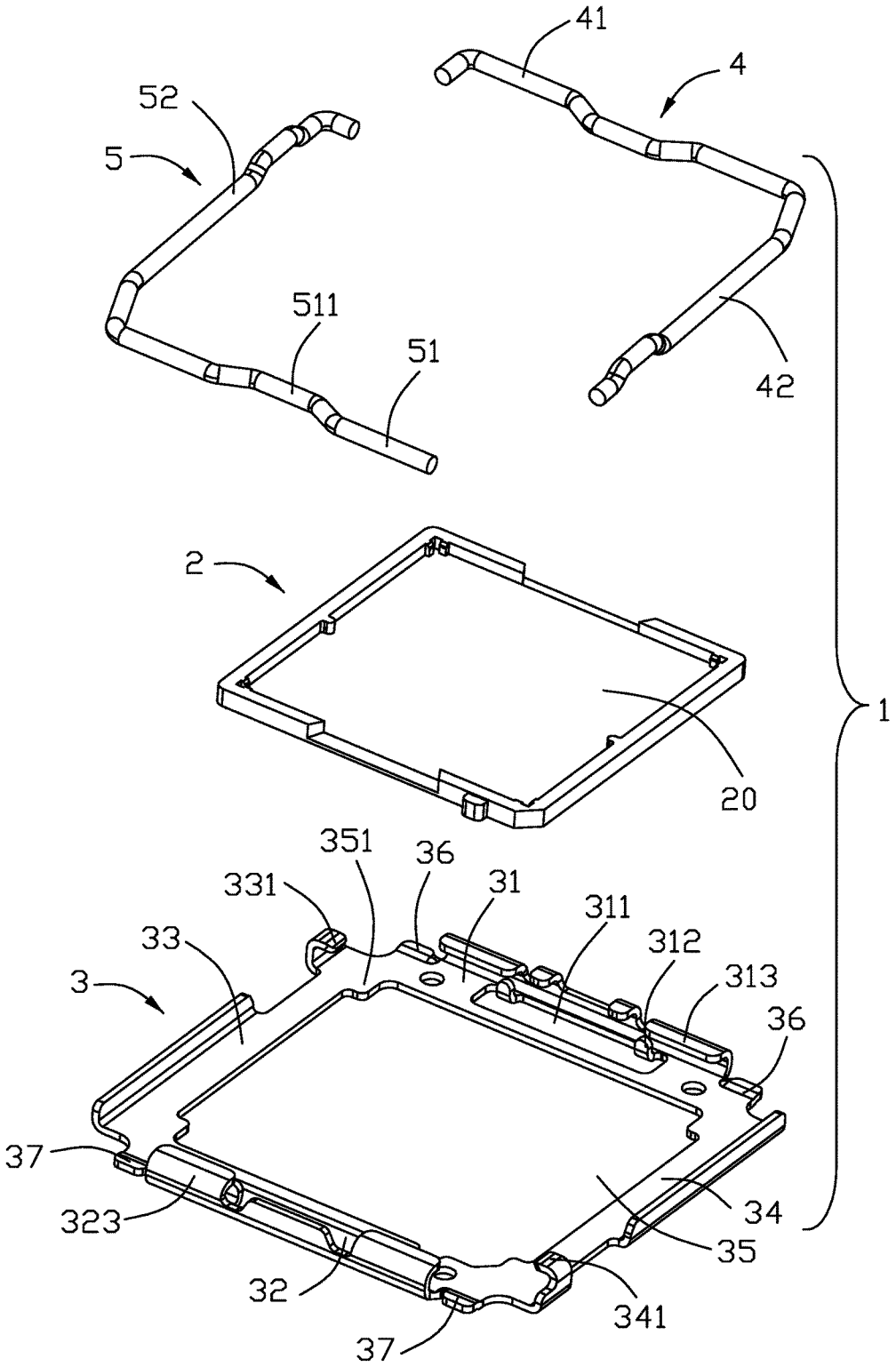
FIG. 3 is a downwardly exploded perspective view of the electrical connector without a cover of FIG. 1.
Figure 4:
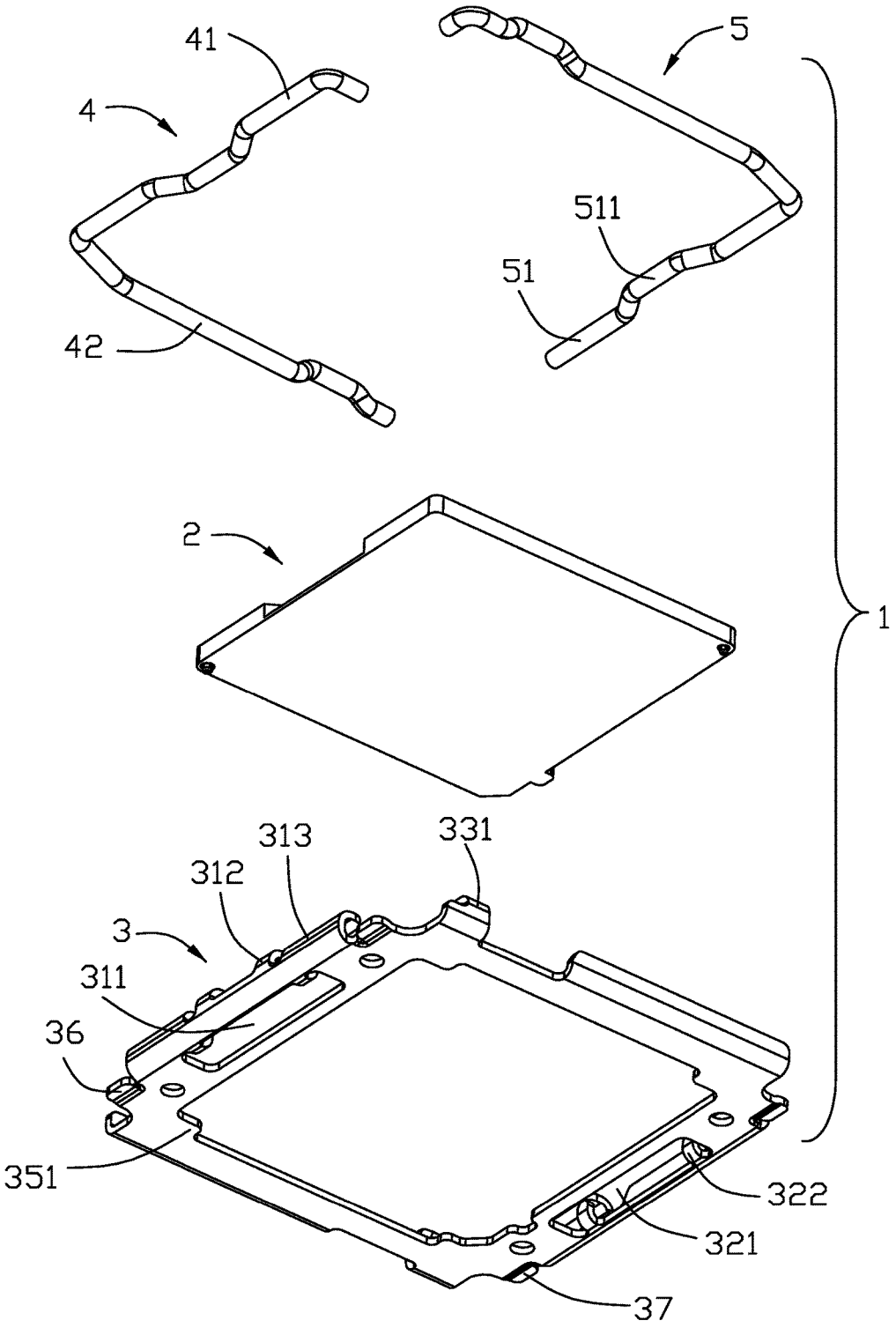
FIG. 4 is an upwardly exploded view of FIG. 3.

Referring to FIGS. 3 and 4, the base 1 includes an insulative housing 2, a plurality of terminals (not shown) retained in the base 1, and a fixing member 3 surrounding around the insulative housing 2. The insulative housing 2 includes a receiving space 20 for receiving the chip module 200 therein. The base 1 includes a first pivot member 4 and a second pivot member 5. Both of the first pivot member 4 and the second pivot member 5 are substantially L-shaped and pivotally mounted on the fixing member 3. The first pivot member 4 includes a first locking portion 41 and a first operating portion 42 extending therefrom. The second pivot member 5 includes a second locking portion 51 and a second operating portion 52 extending therefrom. The second locking portion 51 has a bearing portion 511 extending therefrom. The second operating portion 52 and the bearing portion 511 are disposed on the same side of the second locking portion 51.

The fixing member 3 with a mounting space 35 is a hollow frame structure disposed around the base 1. The fixing member 3 includes a first mounting portion 31, a second mounting portion 32, and two lateral sides 33, 34 connecting therebetween. The first mounting portion 31 and the second mounting portion 32 are disposed at two opposite sides of the fixing member 3. The first mounting portion 31 includes a first cavity 311, two first stopping portions 312 extending upwardly from an interior side of the first cavity 311, and two first protruding portions 313 extending upwardly from an exterior side of the first mounting portion 31. The first protruding portions 313 bend inwardly to the first stopping portions 312. The first protruding portions 313, the first mounting portion 31 and the first stopping portions 312 form a receiving space to receive the first locking portion 41. The second mounting portion 32 include a second cavity 321, two second stopping portions 322 extending upwardly from an interior side of the second cavity 321, and two second protruding portions 323 extending upwardly from an exterior side of the second mounting portion 32. The second protruding portions 323 bend inwardly to the second stopping portions 322. The second protruding portions 323, the second mounting portion 32 and the second stopping portions 322 form a second receiving space to receive the second locking portion 51. The first mounting portion 31 includes two first standoffs 36 at two lateral edges thereof. The second mounting portion 32 includes two second standoffs 37 at two lateral edges thereof. The first standoffs 36 and the second standoffs 37 bend upwardly from the first mounting portion 31 and the second mounting portion 32. A gap is formed between the first locking portion 41 and the first mounting portion 31 because of the two lateral sides of the first locking portion 41 standing on the two first standoffs 36. A gap is formed between the second locking portion 51 and the second mounting portion 32 because of the two lateral sides of the second locking portion 51 standing on the two second standoffs 37. Each of the lateral sides 33, 34 has a latching portion 331, 341 extending upwardly therefrom and bending inwardly to the mounting space 35. When the cover 6 is closed, the first operating portion 42 and the second operating portion 52 are locked by the latching portions 331, 341, respectively. The two latching portions 331, 341 are located at a diagonal line of the fixing member 3. The mounting space 35 is of a rectangle frame. The fixing member 3 has four projections 351 protruding inwardly from four inner corners of the mounting space 35. The fixing member further defines a pair of receiving slot 332 and 342 in the corresponding lateral sides 33, 34 intimately facing the insulative base 2.

Figure 5:
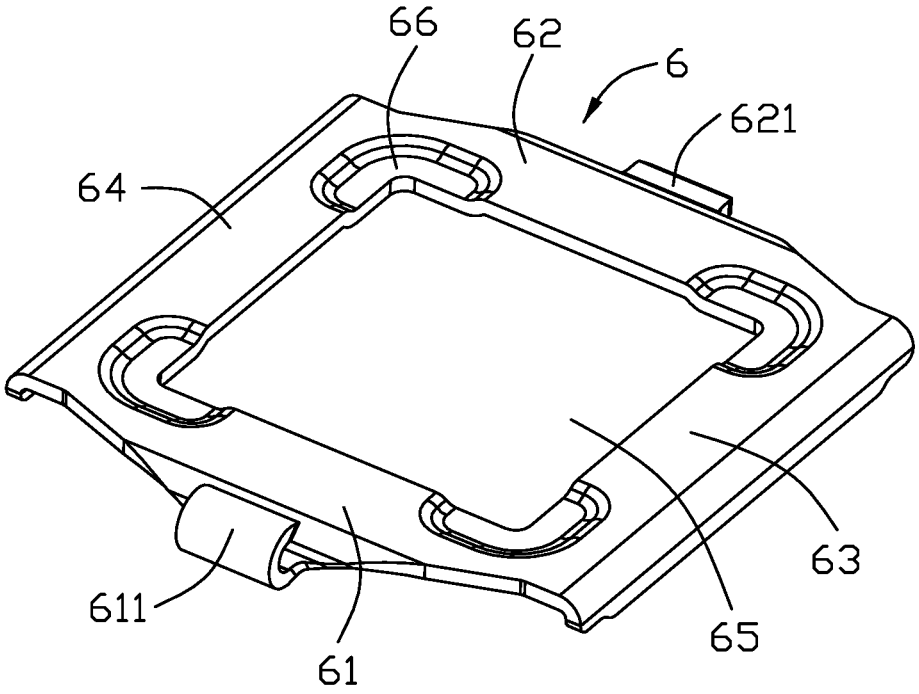
FIG. 5 is a perspective view of the cover of the electrical connector.
Figure 6:
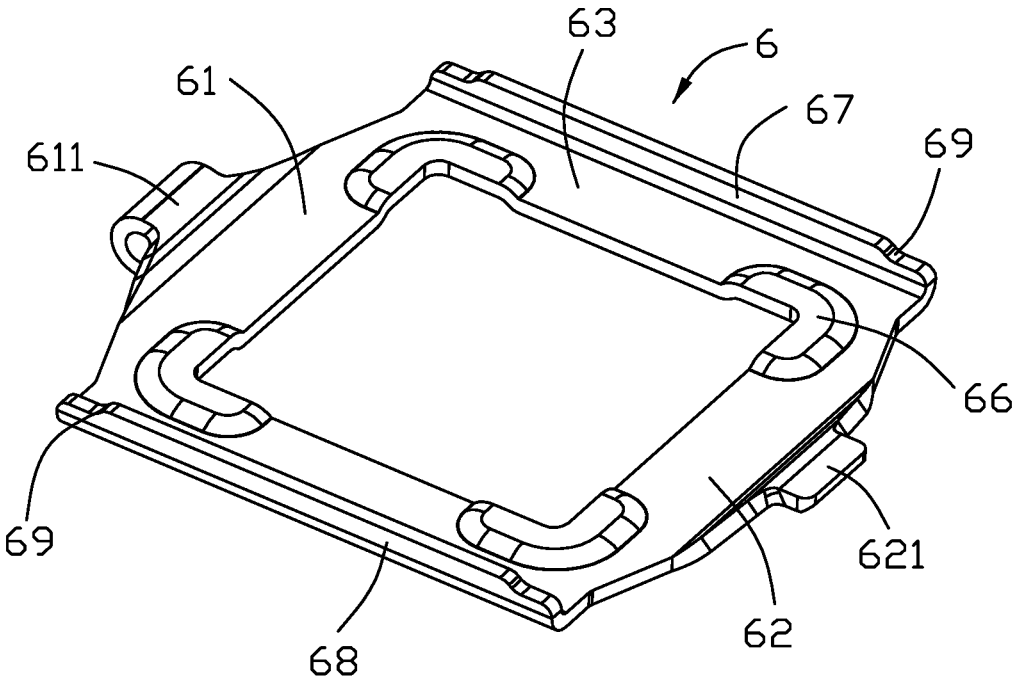
FIG. 6 is another perspective view of FIG. 5.

Referring to FIGS. 5 and 6, the cover 6 with a rectangular opening 65 is of a rectangle structure, and has a first edge/side 61, a second edge/side 62 opposite to the first edge 61 in a front-to-rear direction, a third edge/side 63 and a fourth edge/side 64 opposite to the third edge 63 in a transverse direction perpendicular to the front-to-rear direction. A part of the chip module 200 could go through the rectangular opening 65. The cover 6 has four pressing portions 66 located at four inner corners to press the chip module 200. The pressing portions 66 are formed by stamping, and four concave spaces are formed at a top side of the cover 6. Each of the pressing portions 66 is of an L-shaped configuration. The cover 6 is provided with a pivoting portion 611 extending outwardly from the first edge 61. The pivoting portion 611 is pivotally connected to the first locking portion 41 so that the cover 6 is pivotally mounted to the fixing member 3. The cover 6 includes an extending portion 621 extending outwardly from the second edge 62. Two walls 67, 68 extend downwardly form the third edge 63 and the fourth edge 64, respectively, to be received within the receiving slots 332, 342 in the lateral sides 33, 34. Each of the walls 67, 68 has two cutouts 69 located at opposite lateral sides thereof outside of the corresponding receiving slot 332, 342 for avoiding interfering with the projections 351.

Referring to FIGS. 1 to 4, the first locking portion 41 and the second locking portion 51 are retained in the receiving space. The first locking portion 41 is held by the pivoting portion 611 so that the cover 6 is pivotally connected to the fixing member 3. All of the cover 6, the first pivot member 4 and the second pivot member 5 could be rotated between an open state and a close state. During assembly process, all of the cover 6, the first pivot member 4 and the second pivot member 5 stay in the open state. Firstly, the chip module 200 is mounted on the insulative housing 2. Secondly, both of the cover 6 and the first operating portion 42 are rotated downwardly, and the first operating portion 42 is locked by the latching portion 341. Then, the second operating portion 52 is rotated downwardly to operate the second locking portion 51 so that the bearing portion 511 is fastened the extending portion 621 in the second cavity 321. The second operating portion 52 is locked by the latching portion 331. The four pressing portions 66 press four corners of the chip module 200 so that a force balance is achieved. The chip module 200 could be connected to the electrical connection 100 stably and safely.

Figure 7:
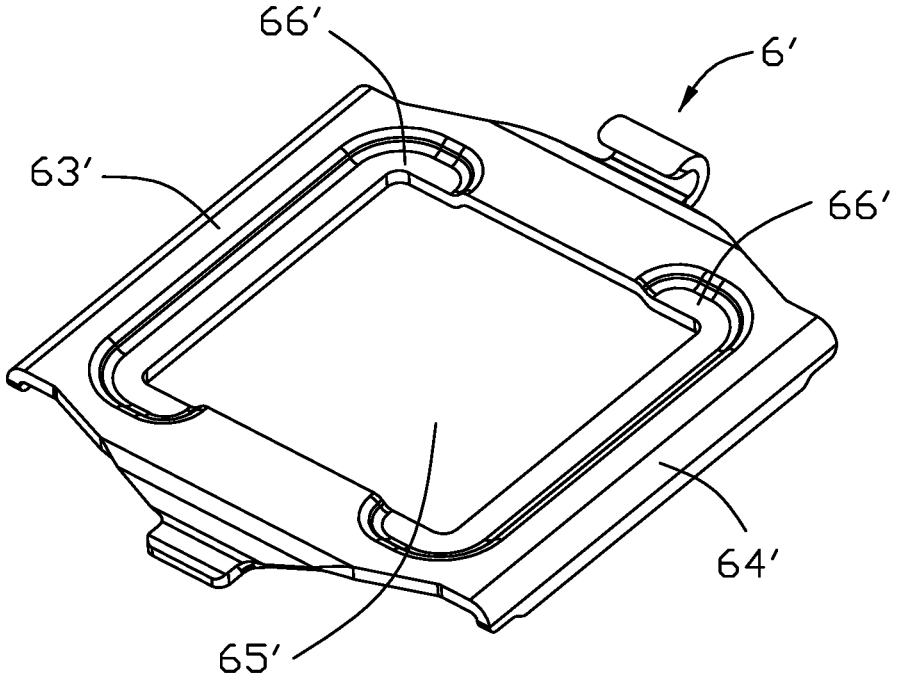
FIG. 7 is a perspective view of a second embodiment of the cover.

FIG. 7 shows another embodiment of the present invention. The two pressing portions 66 located on the third edge 63' connect with each other into a new pressing portion 66'. The two pressing portions 66 located on the fourth edge 64' connect with each other into another new pressing portion 66'. The two new pressing portions press 66' on the two opposite sides of the chip module 200 to achieve a force balance.

Figure 8:
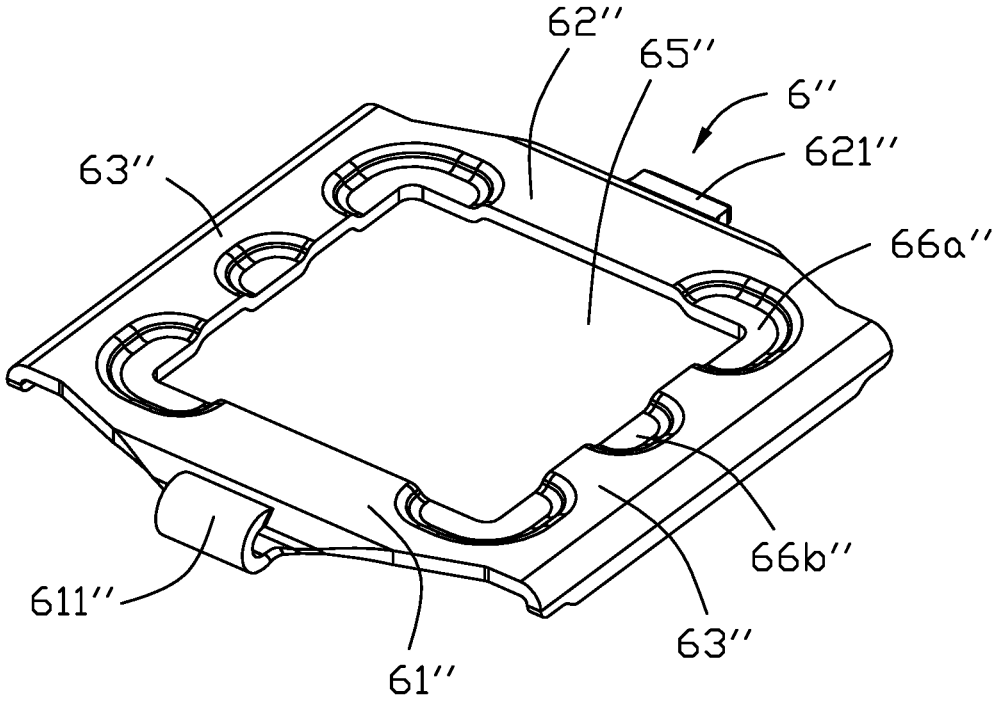
FIG. 8 is a perspective view of a third embodiment of the cover.

FIG. 8 shows a third embodiment of the present invention. The cover 6" with a rectangular opening 65" has a first edge 61", a second edge 62", a third edge 63" and a fourth edge 64". The cover 6" is provided with a pivoting portion 611" extending from the first edge 61" and an extending portion 621" extending from the second edge 62". The cover 6" includes four first pressing portions **66*a*" located at four inner corners to press the chip module 200. The first pressing portions 66*a*" are formed by stamping, and four concave spaces are formed at the top side of the cover 6". The cover 6" further includes two second pressing portions 66*b*" located on the third edge 63" and the fourth edge 64", respectively. Each of the second pressing portions 66*b*" is located between two first pressing portions 66*a*". A center line is defined on the cover 6" along a transverse direction, and the center line passes through the two second pressing portions 66*b*"**.

However, the disclosure is illustrative only, changes may be made in detail, especially in matter of shape, size, and arrangement of sections within the principles of the invention.

What is claimed is:

1. An electrical connector connecting with a chip module, comprising:

base with a receiving space for bearing the chip module; and a metallic cover covering on the base, the cover comprising a first edge, a second edge opposite to the first edge in a front-to-rear direction, a third edge and a fourth edge opposite to the third edge, the four edges connected with each other to form a rectangular opening, the first edge pivotally connected to the base, and an extending portion extending forwardly from the second edge;

wherein the metallic cover comprises at least four first pressing portions located at four inner corners of the cover to press the chip module;

wherein the first pressing portions are formed by stamping, and four concave spaces are formed at a top side of the cover;

wherein the four first pressing portions are disposed on four corners of the rectangular opening, and each of the pressing portions is of an L-shaped configuration;

wherein the base comprises an insulative housing, a plurality of terminals retained in the insulative housing and a metallic fixing member surrounded around the insulative housing, the fixing member with a mounting space comprises a first mounting portion and a second mounting portion opposite to the first mounting portion, four projections extend from the four inner corners of the mounting space, and the cover comprises four cutouts corresponding to the four projections; and wherein the base comprises a first pivot member mounted on the first mounting portion, the cover is pivotally connected to the fixing member by the first pivot member, and the first mounting portion comprises two first standoffs protruding upwardly from the two opposite sides thereof.

2. The electrical connector as claimed in claim 1, wherein two of first pressing portions located on the third edge connect with each other, and the other two first pressing portions located on the fourth edge connect with each other.

3. The electrical connector as claimed in claim 1, wherein the cover comprises two second pressing portions located on the third edge and the fourth edge respectively, and each of the second pressing portions is located between two first pressing portions.

4. The electrical connector as claimed in claim 3, wherein a center line is defined on the cover along a transverse direction perpendicular to the front-to-rear direction, and the center line passes through the two second pressing portions.

5. The electrical connector as claimed in claim 1, wherein the first pivot member comprises a first locking portion and a first operating portion extending therefrom, and a gap is formed between the first locking portion and the first mounting portion because of the two lateral sides of the first locking portion standing on the two first standoffs.

6. An electrical connector comprising:

an insulative base forming a rectangular receiving space for snugly receiving a chip module therein; and a metallic cover moveably positioned upon the insulative base in a pivotal manner, and having a rectangular configuration with opposite first and second sides and opposite third and fourth sides commonly define a rectangular opening, said first side and said second side parallel to each other, said third side and said fourth side parallel to each other, said first side and said second side perpendicular to said third side and said fourth side, wherein at least four downwardly protruding pressing portions are located on four corners of said metallic cover and aligned with four corners of the rectangular receiving space for downwardly pressing in the receiving space;

wherein said four downwardly protruding pressing portions are formed by stamping with four concave spaces at a top side of the cover and directly formed from four corners of the rectangular opening;

wherein the electrical connector further including a metallic fixing member including four interconnected bars commonly in a horizontal plane to form an opening snugly surrounding the insulative base, wherein a pair of L-shaped levers pivotally mounted upon two opposite sides of the fixing member, the cover is pivotally mounted upon one of said levers, and a pair of standoffs are formed around two diagonally opposite corners of the fixing member outside of the corresponding two corners of the insulative base, respectively, for supporting the levers, respectively; and wherein the metallic fixing member including four interconnected bars commonly in a horizontal plane to form an opening snugly surrounding the insulative base and forming a pair of elongated receiving slots along corresponding third and fourth sides of the insulative base, and the cover includes a pair of downwardly extending walls to be received within the pair of elongated receiving slots, respectively.

7. The electrical connector as claimed in claim 6, wherein said metallic cover extends in a horizontal plane in a full flat manner except said at least downwardly protruding pressing portions.

8. The electrical connector as claimed in claim 6, wherein said downwardly protruding pressing portions commonly define a rectangular peripheral boundary which is essentially aligned with a periphery of the rectangular receiving space in a vertical direction.

9. The electrical connector as claimed in claim 6, wherein said four downwardly protruding pressing portions are discrete from one another without any interconnection between every adjacent two downwardly protruding pressing portions.

10. An electrical connector comprising:

an insulative base forming a rectangular receiving space for snugly receiving a chip module therein; and a metallic cover moveably positioned upon the insulative base, and having a rectangular configuration with opposite first and second sides and opposite third and fourth sides commonly define a rectangular opening, said first side and said second side parallel to each other, said third side and said fourth side parallel to each other, said first side and said second side perpendicular to said third side and said fourth side, a pair of downwardly extending walls formed along the third side and the fourth side;

a metallic fixing member including four interconnected bars commonly in a horizontal plane to form an opening snugly surrounding the insulative base and forming a pair of elongated receiving slots beside the corresponding third and fourth sides of the insulative base to receive said pair of downwardly extending walls therein, respectively;

wherein the metallic cover is pivotal about the first side and at least a pair of downwardly protruding pressing portions are respectively formed at corners on the corresponding third and fourth sides of the metallic cover for downwardly pressing the chip module received in the receiving space;

wherein said at least two downwardly protruding pressing portions are formed by stamping having four concave spaces at a top side of the metallic cover and located within a boundary of the receiving space in a top view;

wherein a bottom end of each of said pair of downwardly extending walls is lower than a bottom end of each of the two downwardly protruding pressing portions;

wherein each of said pair of downwardly extend walls has a pair of cutouts at two opposite ends which are located within corresponding receiving slot.

* * * * *